US006067904A

United States Patent [19]

Bachmann

[11] Patent Number: 6,067,904

[45] Date of Patent: May 30, 2000

[54] INKING-PAD PRINTING PRESS

[75] Inventor: Louis Bachmann, Wil, Switzerland

[73] Assignee: Teca-Print AG, Thayngen, Switzerland

[21] Appl. No.: 09/155,749

[22] PCT Filed: Apr. 2, 1997

[86] PCT No.: PCT/CH97/00134

§ 371 Date: Sep. 3, 1998

§ 102(e) Date: Sep. 3, 1998

[87] PCT Pub. No.: WO97/37850

PCT Pub. Date: Oct. 16, 1997

[30] Foreign Application Priority Data

Apr. 3, 1996 [CH] Switzerland ..... 0861/96

[51] Int. Cl.[7] ..... B41F 31/02

[52] U.S. Cl. ..... 101/170; 101/167

[58] Field of Search ..... 101/35, 41, 42, 101/43, 44, 150, 163, 167, 169, 170

[56] References Cited

U.S. PATENT DOCUMENTS

| | | | |
|---|---|---|---|
| 4,557,195 | 12/1985 | Phlipp | 101/163 |
| 4,905,594 | 3/1990 | Phillip et al. | 101/163 |
| 5,419,247 | 5/1995 | Bachmann | 101/364 |
| 5,669,301 | 9/1997 | Bachmann et al. | 101/163 |
| 5,875,716 | 3/1999 | Scheuhing | 101/170 |

FOREIGN PATENT DOCUMENTS

| | | |
|---|---|---|
| 568 133 | 11/1993 | European Pat. Off. . |
| 1 923 374 | 2/1970 | Germany . |
| 37 37 937 | 5/1989 | Germany . |
| 688 545 | 11/1994 | Switzerland . |
| WO 93/11943 | 6/1993 | WIPO . |

*Primary Examiner*—John S. Hilten
*Assistant Examiner*—Amanda B. Sandusky
*Attorney, Agent, or Firm*—Sughrue, Mion, Zinn, Macpeak & Seas, PLLC

[57] ABSTRACT

An inking-pad printing press has at least one container (1) for inking a printing plate and a press device for pressing the container against the printing plate. The printing plate (2) and the container are moved in a mutually reciprocating manner by a drive mechanism in order to ink a printing block of the printing plate. During the inking process, the position of the container relative to the longitudinal axis of the printing block and hence to the printed image is varied by a further relative movement. This further relative movement is, for example, an oscillating, rolling, swaying, swinging or thrusting movement.

18 Claims, 3 Drawing Sheets

INKING-PAD PRINTING PRESS

BACKGROUND OF THE INVENTION

This invention relates to a tampon print machine having at least one container for the coloring of a printing plate, a pressing apparatus for pressing the container to the printing plate, and a drive to move to the printing plate and the container for the coloring of the block of the printing plate.

The invention also relates to a process for the printing of the tampon, in which, using a container open at the bottom, a printing block is colored and, with a tampon, printing or partial images are transferred to a working material.

Tampon printing machines and processes are well known. These have a color container that is open at the bottom which rests on a movable intaglio printing plate, also called a printing block. The coloring container has an edge lying adjacent to the printing plate and having a wedge-like sharpened bevel. When the coloring container is full, a shifting of the printing plate applies color in this way and is, at the same time, backfilled with a further movement. Using a tampon, after the color application, the print image is transferred to a printing medium. During the coloring, the container is constantly pressed against the printing plate, which can occur by means of a printing pen. A tampon printing machine of this type is disclosed in WO-93/11 943. In Swiss Patent Application No. 03 481, 94-4 of Nov. 18, 1994, the applicant suggests a process and an apparatus for tampon printing in which the container is turned around a vertical axis during coloring. This tampon printing machine has, among others, the advantage that the pressing pressure of the container at the surface of the printing block can be reduced. The wearing off of the backfilling edge and the printing block is thus less than before. The present application makes reference to this not yet published application.

It is the object of the present invention to provide a tampon printing machine and a process for tampon printing which characterizes itself in exhibiting even longer life span and a higher printing quality.

This object is solved by a tampon printing machine according to the invention such that, during the coloring, the relative position of the container to the length-wise axis of the printing block and thus to the printed image is changed through a further relative movement. In the process according to the invention the container, during coloring, moves on its edge not only in a straight line in a first relative movement, but also regularly or irregularly sweeps over a surface on its outermost region in a second relative movement.

The tampon printing machine and the process according to the invention distinguish themselves through the following advantages. The container and the printing block will not grind into one another even after prolonged operation. Thus, using the same container, the printing block can easily be replaced. The printing plate is worn off more evenly, since the printing plate with the printing block approach the container at a different angle. Both the container and the printing block are less worn off.

As a result of the further development of the invention, the second relative movement is oscillating, coiling, swinging, run back and forth, or pushing. Such a movement is forced onto the container upon further development of the invention through two eccentrics which, either dependent on or independent from one another, perform circular movements. The eccentrics can either, dependent on one another and in same steps, transfer a circular movement onto the pot or dependent on one another and not in same steps, transfer each a circular movement onto the container, forcing onto it a oscillating movement. Finally, one can use the eccentrics to either independently from one another and in same or not same steps transfer a circular movement onto the container. The eccentrics can be operated, for example, each with a turning piston rod. A suitable drive is disclosed in the above-mentioned Swiss patent application.

According to a further development of the invention, the container is pushed forward and backward with two linear drives in the x- and y-directions. These movements can be performed dependent on or independent from one another, and essentially randomly combined.

The container is preferably not round and comparatively flat. If it is long, then there is the special advantage that the printing block can be colored upon performing a comparatively short movement. Since the container does not have to perform a full turning movement, it can easily be connected to a line for the supplying of printing ink. This would be problematic in the case of a container that endlessly turns or turns in large circles or that is circular.

Further advantageous characteristics are revealed in the dependent claims, the following description and the diagrams.

Examples of embodiments of the invention are described in the following using diagrams. Shown in:

DETAILED DESCRIPTION OF THE PREFERRED EMBODIMENTS

Figure 1:
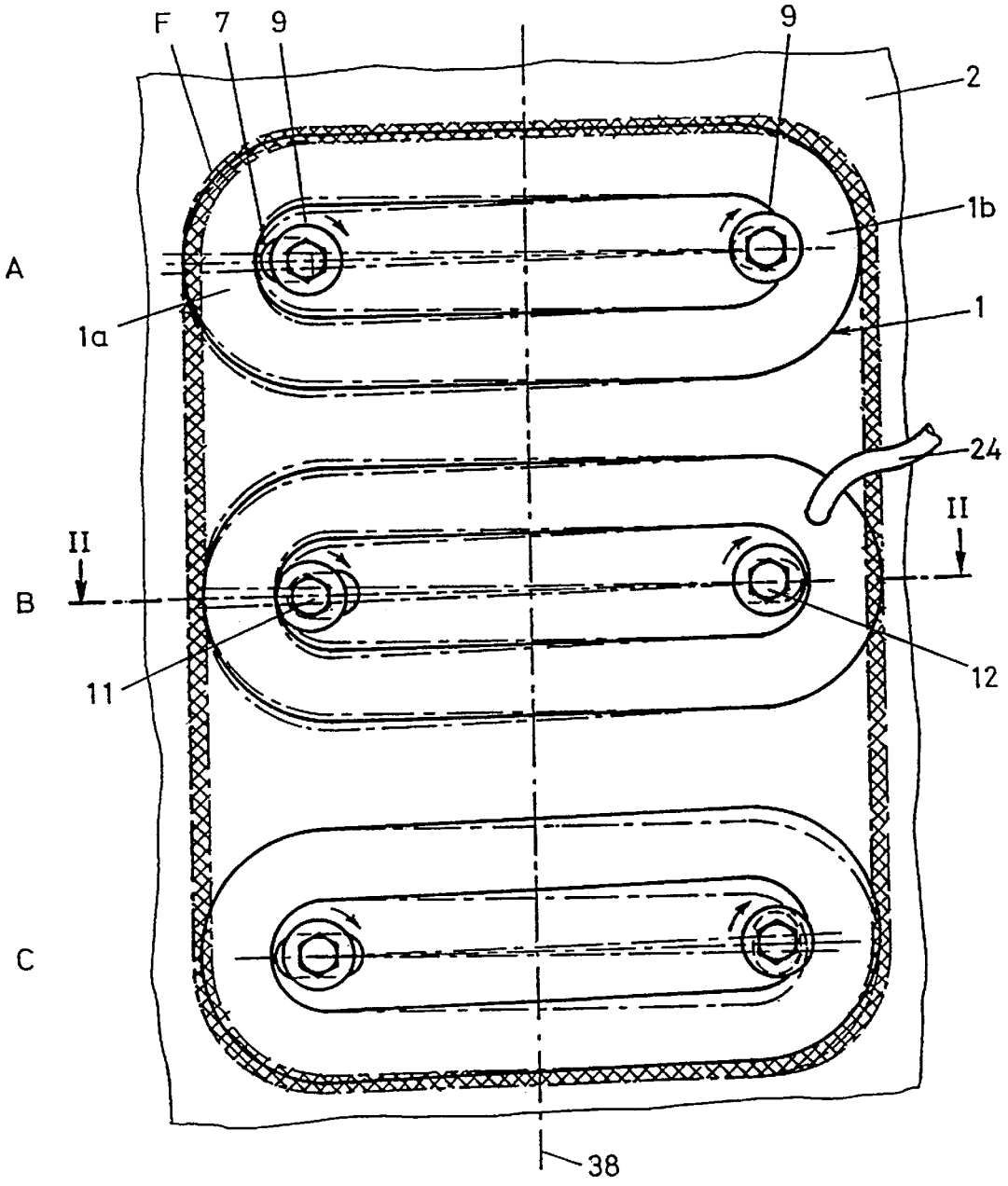
FIG. 1 schematically shows three different positions of a container on a printing block during coloring.
Figure 2:
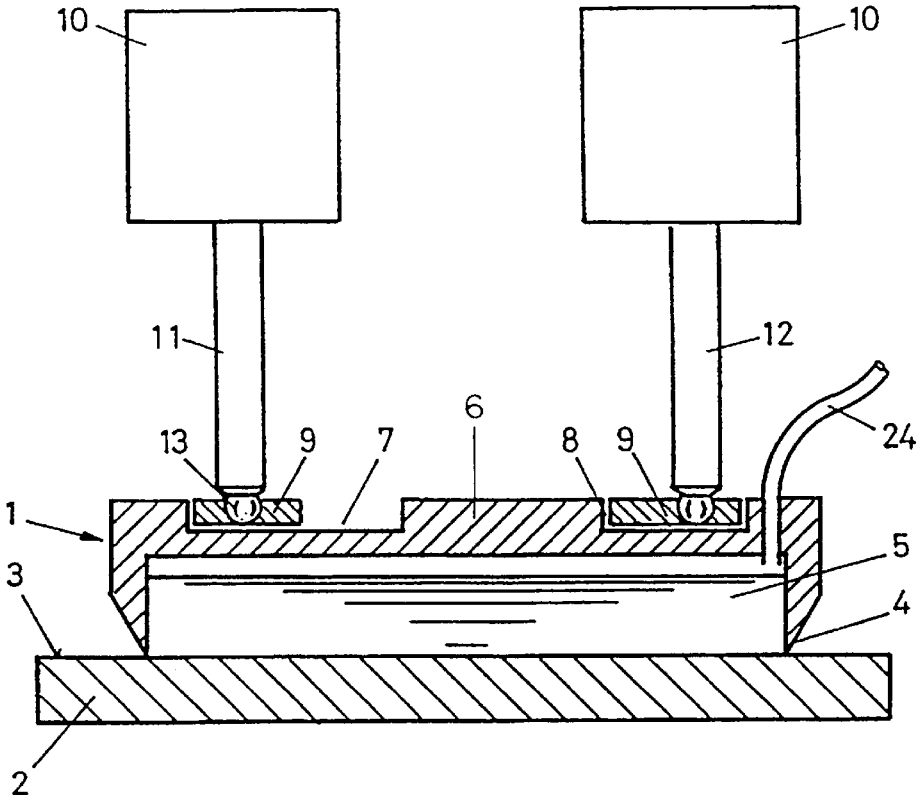
FIG. 2 is a cross-section along the line II—II of FIG. 1.

FIG. 1 shows a printing plate 2 with a printing block not shown here, onto which a container 1 is pressed using two vertical rods 9. As shown in FIG. 2, the container 1 with a surrounding, sharp edge 4 rests on the top side 3 of the printing plate 2. The container 1 holds printing ink 5 or another suitable printing medium that can be constantly re-supplied over a line 24. However, if plate 2 is moved back and forth with a drive not shown here, then the printing ink 5 is applied onto the top side 3 of the printing plate 2 and thereafter backfilled. This itself is well known and need not be explained here further.

In a ceiling partition 6 of the container 1, arranged at a distance to each other are two guide mechanisms 7 and 8, in each of which an eccentric 9 is positioned rotatingly. Vertical rods 11, 12 grip each eccentric 9, which can each be turned independently using a drive 10. A joint 13 is provided between each rod 11, 12 and the container 1. The rods 11, 12 are preferably piston rods which simultaneously exercise pressure on the container 1. Such a drive is disclosed in Swiss Patent Application No. 34 81/94.

FIG. 1 shows three positions, A, B and C, which the container 1 assumes during the coloring of the printing plate. During the coloring, the relative movement between the container 1 and the printing plate is substantial. In the embodiment shown here, the container 1 is held tightly and the printing plate moved back and forth in a first relative movement. Also imaginable, however, is an embodiment in which the printing plate is held tightly and the container 1 is moved back and forth. In FIG. 1, the three positions A, B and C are pulled apart merely for diagrammatic reasons. During the coloring, the rods 11 and 12 are turned around their vertical axis. The eccentrics 9 are so positioned that, in position A, the left end 1*a* performs an oscillating movement to achieve one type of second relative movement to achieve one type of second relative movement. So that this movement can be forced onto container 1, the left eccentric is lead into a longitudinal guide mechanism 7. Thus the stroke acting in a direction against this eccentric balance out that of the other eccentric. During this oscillating movement, the container in FIG. 1 is moved toward the right into the position. The eccentric is shifted correspondingly into the longitudinal guide mechanism 7. In position C which follows position B laterally, the left end 1*a* of the container 1 is comparatively still, while the right end 1*b* oscillates. The edge 4 of the container 1 thus does not move in a line, as would be the case with a round turning pot, but instead sweeps over a surface F, as shown schematically in FIG. 1. The relative position of container 1 to the longitudinal axis 38 of the printing plate 2 or of the printing block constantly changes during the coloring. The oscillating movement of the container 1 can now be arranged such that the printing block approaches the container 1 at a different angle and thus the printing block is worn off more evenly.

Figure 3:
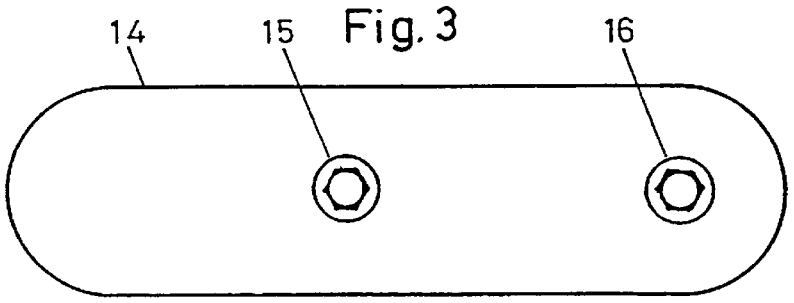
FIG. 3 is a schematic top view of a container according to a variant.

In the embodiment according to FIG. 3, a container 14 is rotatingly fixed approximately at its center 15 and has at a distance from it an eccentric 16 which, during the coloring, performs a circular movement. In so doing, a swinging movement can be forced onto the center 15 of the container 14.

Figure 4:
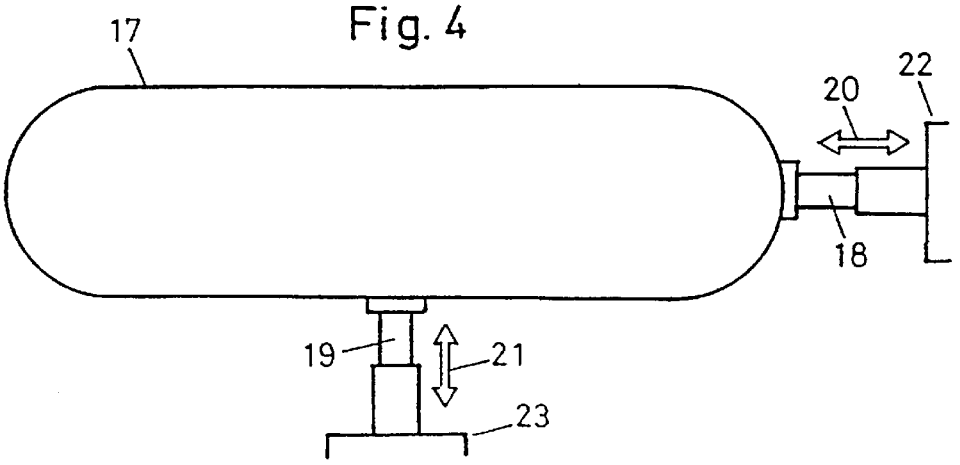
FIG. 4 is a schematic of a container with a drive according to a variant.

According to a further embodiment as seen in FIG. 4, provided are two linear drives 22 and 23, each of which executes a pushing, back-and-forth movement by means of a rod 18 or 19 in the direction of the arrows 20 or 21 onto a container 17. Drives 22 and 23 are, of course, connected with the container 17 via joints. Through a suitable steering of the drives 22 and 23, an oscillating movement can also be imparted to the container 17. This movement can, however, also be coiling, swinging, running back and forth, or pushing. Also here, it is essential that the edge 4 sweeps a surface and thus works itself less into the top side 3 of the printing plate 2.

Figure 5:
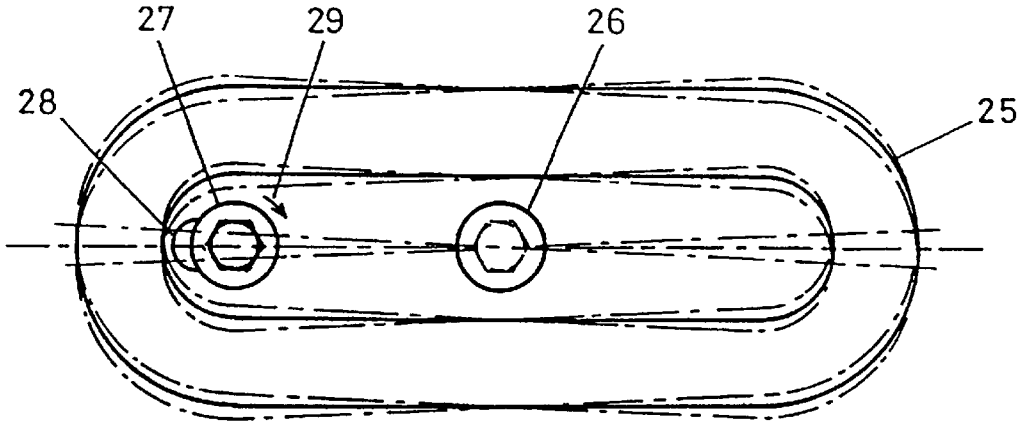
FIGS. 5 to 7 are further embodiments, each with a linear drive.

In the embodiment according to FIG. 5, a container 25 is rotatingly fixed approximately in the center with a vertical rod 26, and, at a distance from it, a limitedly shiftable eccentric 27 is disposed in an elongated hole 28. The eccentric 27 is turnable in the direction of arrow 29 via a drive not shown. During the turning of the eccentric 27, the container 25 moves about its center, as shown in FIG. 5 with hyphenated lines. The movement is completed while the printing plate is moved linearly for the coloring of the printing block. The eccentric 27 could be replaced with a linear drive not shown, which at a distance to the rod 26 grips the container 25 and moves it across back and forth to its complementary direction.

Figure 6:
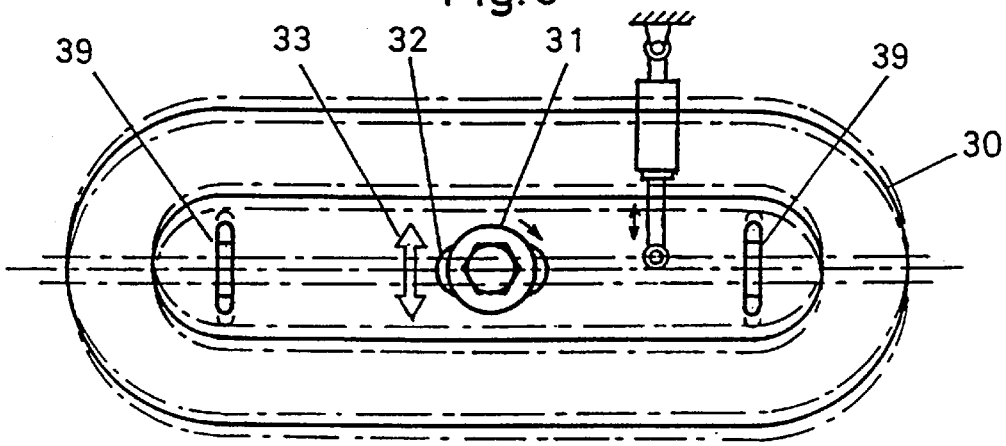

In the embodiment according to FIG. 6, a container 30 has, at its center, an eccentric 31 positioned in a guide mechanism 32 and, at a distance from it, two longitudinal guide mechanisms 39. When turning the eccentric 31, the container 30 is moved back and forth in the direction of the double arrow 33 across the longitudinal direction of the container 30. Also in this case, the eccentric 31 can be replaced with a linear drive or another suitable drive.

Figure 7:
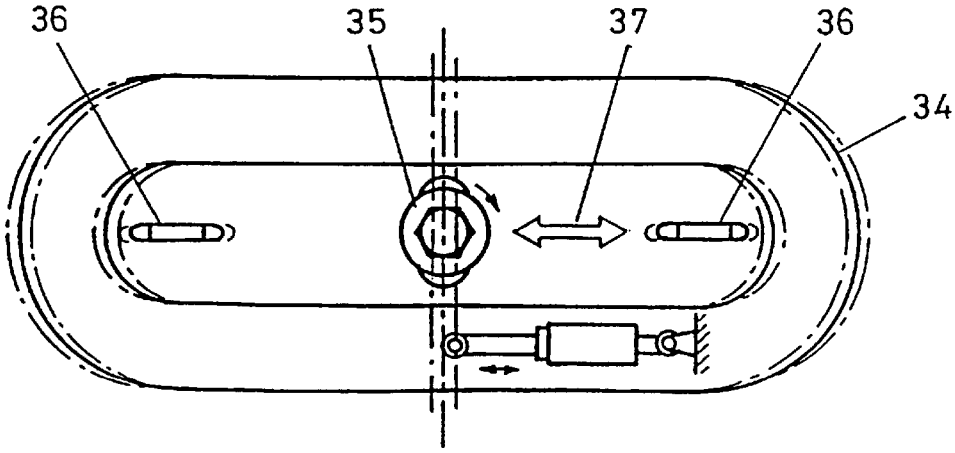

Finally, FIG. 7 shows a container 34 which also has an eccentric 35 in the center. The container 34 has two longitudinal guide mechanisms 36, such that, when turning the eccentric 35, the container 34 performs an oscillating movement in the direction of the double arrow 37.

The above-mentioned movements can also be combined. Different movements can also be performed temporally one after the other. Eccentrics are particularly suited as drives; however, other drives which can move the container during the coloring can also be used. In all cases, moving the container while the printing plate remains still results in an enlargement of the colored area.

Basically, the relative movement between the container and the printing plate is essential. Imaginable is therefore also an embodiment in which, not the container, but the printing plate is moved, for example, oscillatingly in addition to its translational movement. The additional translational movement is comparatively slow; for example, the eccentric is turned once during the coloring. Slower or faster movements are also provided for.

What is claimed is:

1. A tampon printing machine with at least one container for coloring of a printing plate, having a pressing apparatus for pressing the container against the printing plate and a drive to move the printing plate and the container relative to one another for the coloring of a block of the printing plate in a first relative movement, wherein, during coloring, the pressing apparatus and drive impart a second relative movement to the container so as to change the relative position of the container to the longitudinal axis of the printing block in the plane of the top side (3) of the printing plate (2).

2. Tampon printing machine according to claim 1, wherein the second relative movement of the container is one of oscillating, coiling, swinging, running back and forth and pushing.

3. Tampon printing machine according to one of claim 1, wherein the printing plate is moved back and forth linearly by a second drive to provide the first relative movement.

4. Tampon printing machine according to one of claim 1, wherein means for moving the container at least temporarily during the coloring is coupled to the pressing apparatus and the container.

5. Tampon printing machine according to one of claim 1, wherein means of the pressing apparatus impart the second relative movement to the container.

6. Tampon printing machine according to one of claim 1, wherein the container is connected to the drive and the drive grips onto the container in at least two places that are arranged at a distance to one another.

7. Tampon printing machine according to one of claim 4, wherein said moving means imparts a circular movement to the container.

8. Tampon printing machine according to one of claim 4, wherein said moving means imparts an oscillating movement to the container.

9. Tampon printing machine according to one of claim 4, wherein said moving means imparts a coiling or swinging movement to the container.

10. Tampon printing machine according to one of claim 1, wherein two eccentrics of the pressing apparatus move the container during the coloring.

11. Tampon printing machine according to claim 10, wherein the two eccentrics, dependent on one another and in same steps, transfer a circular movement to the container.

12. Tampon printing machine according to claim 10, wherein the two eccentrics, dependent on one another and not in same steps, each transfer a circular movement to the container and force on it an oscillating movement.

13. Tampon printing machine according to claim 10, wherein the two eccentrics, independent from one another and in same or not in same steps, transfer a circular movement to the container to complete an oscillating movement.

14. Tampon printing machine according to claim 1, wherein the container is rotatingly coupled at its center to the pressing apparatus and, at a distance from the center, the container is coupled to an eccentric which imparts a circular movement so that a swinging movement is forced onto the container.

15. A process for tampon printing, comprising the steps of:

coloring a printing block with a container open at the bottom printing or transferring partial images to a working material, moving one of the container and the printing block, during the coloring step, in a first relative movement along a straight line, and moving one of the container and the printing block in a second relative movement so that the plane of the top side (3) of the printing plate (2) sweeps over a surface on the outermost region of the top side.

16. Process according to claim 15, wherein means for pushing the container is provided for generating the second relative movement between the container and the printing plate.

17. Process according to claim 15, wherein during the coloring step the printing plate moves in the first relative movement so as to reciprocate linearly while the container simultaneously moves in the second relative movement in one of an oscillating, coiling, running back and forth and swinging movement.

18. Process according to claim 15, wherein the second relative movement is performed simultaneously with the first relative movement.

* * * * *